US006591641B1

(12) United States Patent
Cann

(10) Patent No.: US 6,591,641 B1
(45) Date of Patent: Jul. 15, 2003

(54) LOCKING DEVICE FOR LOCKROD-TYPE CARGO-CONTAINER CLOSURES

(75) Inventor: Robert Cann, London (CA)

(73) Assignee: Freight Securities, Inc., Ontario (CA)

( * ) Notice: Subject to any disclaimer, the term of this patent is extended or adjusted under 35 U.S.C. 154(b) by 0 days.

(21) Appl. No.: 10/105,816

(22) Filed: Mar. 25, 2002

(51) Int. Cl.[7] ..... E05B 13/08

(52) U.S. Cl. ..... 70/14; 70/19; 70/212; 70/DIG. 65; 292/205; 292/258; 292/259 R; 292/288; 292/DIG. 32

(58) Field of Search ..... 70/14, 19, 94, 70/54–56, 199, 200, 211, 212, 238, DIG. 65; 292/258, 218, 288, 205, DIG. 32, 259 R, 259 A

(56) References Cited

U.S. PATENT DOCUMENTS

| | | | | | |
|---|---|---|---|---|---|
| 2,556,900 | A | * | 6/1951 | Buschhorn | |
| 3,664,164 | A | * | 5/1972 | Zaidener | 70/202 |
| 3,665,736 | A | | 5/1972 | Wilson | 70/78 |
| 4,068,409 | A | | 1/1978 | White | 49/367 |
| 4,372,136 | A | | 2/1983 | Mickelson | 70/14 |
| 4,389,862 | A | | 6/1983 | Hastings | 70/2 |
| 4,397,499 | A | * | 8/1983 | Work et al. | 296/218 |
| 4,866,960 | A | * | 9/1989 | Brower | 70/56 |
| 5,145,222 | A | | 9/1992 | Meyer | 292/258 |
| 5,284,036 | A | | 2/1994 | Rosenbaum | 70/14 |
| D351,984 | S | * | 11/1994 | Victor | D8/331 |
| 5,419,165 | A | * | 5/1995 | Perkins | 70/14 |
| 5,934,116 | A | | 8/1999 | Moore | 70/212 |
| 6,233,984 | B1 | | 5/2001 | Blehi, III | 70/34 |

FOREIGN PATENT DOCUMENTS

| | | |
|---|---|---|
| DE | 40 06 966 | 11/1990 |
| DE | 92 16 616 | 2/1993 |
| EP | 0 535 503 | 4/1993 |

* cited by examiner

*Primary Examiner*—Lloyd A. Gall
(74) *Attorney, Agent, or Firm*—Young & Basile, P.C.

(57) ABSTRACT

The specification discloses a locking device for a cargo-container closure of the type comprising a pair of doors hingedly mounted to a body of the cargo-container, each door having associated therewith in spaced-apart relation at least one upright lockrod the lockrods being adapted for securement to the body in a closed condition of the doors, and in which closed condition of the doors the lockrods are laterally spaced-apart a finite distance. The locking device comprises a pair of separate arms, each arm having a principal length extending between first and second ends, the first end of each arm defining a stop adapted to confront one of the lockrods, and the second ends of the arms being adapted for secure interconnection in end-to-end abutting relation. The second end and principal length of each arm are dimensioned to be receivable between a lockrod and its associated cargo door for interconnection of the second ends intermediate the lockrods, and in an interconnected condition thereof the arms are characterized by a combined length exceeding the finite distance between the lockrods. The combined length of the arms is further characterized in that, when the second ends are securely interconnected intermediate the lockrods, the first end of each arm resists movement of one or the other of the lockrods to thereby prevent significant opening of the cargo doors.

14 Claims, 3 Drawing Sheets

LOCKING DEVICE FOR LOCKROD-TYPE CARGO-CONTAINER CLOSURES

FIELD OF THE INVENTION

The present invention relates generally to locking devices for the closures of cargo containers, for instance such as may be towed by semi-trucks and like vehicles, and more particularly to an improved locking device for such lockrod-type cargo-container closures comprising a pair of interconnectable arms adapted to confront the lockrods in a closed condition of the closure and resist movement of the lockrods to thereby prevent significant opening of the cargo-container closure.

BACKGROUND

Each year in this country, vast quantities of goods of all descriptions are transported and stored in large cargo containers. Commonly, these containers comprise trailers such as may be towed by semi-trucks. Due to the great size of this country, it is frequently the case that the transportation of goods from one place to another cannot be completed in a single day, and it therefore becomes necessary for the vehicle driver to stop and rest. Indeed, federal regulations mandate certain maximum periods of uninterrupted travel for the drivers of commercial cargo-hauling vehicles.

It is likewise commonplace for goods of all descriptions to be stored for extended periods of time in cargo containers unattached to a semi-truck or other towing vehicle. For instance, one or more semi-trailers parked adjacent a business may be employed as convenient warehousing for component parts awaiting assembly, or for finished goods awaiting shipment.

Unfortunately, stationary cargo-containers, whether standing alone or attached to an unmoving conveyance, are attractive targets for thieves. Annually, the theft of goods from cargo-containers causes loss to the owner of the goods, loss to the vehicle entrepreneur and the vehicle insurance carrier in the case of goods stolen during transportation, and loss to the consuming public at large.

Referring to FIG. 1, which depicts the rear of a conventional cargo-container 5, and more specifically a cargo-container of the type adapted for towing by a semi-truck, it will be seen that such containers typically include a closure comprising a pair of outwardly swinging cargo doors 6 hingedly mounted to the body 7 of the cargo-container. The cargo doors 6 have free edges that lie along a common, intermediate scam 8 in a closed condition of the doors. At least one upright lockrod 9 is associated with each door 6, each such lockrod 9 held in place by a plurality of eyelets 10 securely positioned on the doors 6 at spaced locations along the length of the lockrods 9, as shown. The eyelets 10 position the lockrods 9 in spaced-apart relation from the surface of the cargo doors 6, typically a distance of about $5/16^{th}$'s of an inch. Each lockrod 9 is capable of rotary movement about its longitudinal axis by means of laterally protruding handles 11. The ends of the lockrods 9 are selectively cooperatively engageable with receiving means (not shown) provided on the body 7 of the cargo container. When the cargo doors 6 are in the closed condition thereof (such as illustrated), the lockrods 9 are rotatable to bring their ends into cooperative engagement with these receiving means, all in conventional fashion. By engaging the ends of the lockrods 9 with these receiving means, it will be appreciated that the cargo doors 6, while not thereby securely locked in the closed condition, are prevented from swinging freely open on their hinges, particularly when the cargo doors 6 are acted upon by shifting cargo within the container 5, such as may occur during transportation by semi-truck. By disengaging the ends of the lockrods 9 from the receiving means, the doors 6 may be swung open upon their respective hinges, which movement of the doors necessarily causes the associated lockrods 9 to move radially outwardly and away from each other. Exemplary cargo-container arrangements of the lockrod-type such as described above are also disclosed in U.S. Pat. No. 5,145,222, issued to Meyer, U.S. Pat. No. 4,389,862, issued to Hastings, U.S. Pat. No. 5,284,036, issued to Rosenbaum, and U.S. Pat. No. 6,233,984, issued to Blehi, the disclosures of which are incorporated herein by reference in their entireties.

Various means have been devised over the years to securely lock the closures of cargo-containers against unwanted opening, and particularly against unauthorized access by thieves. In their simplest form, these means comprise securing the lockrod handles in place, for instance by a padlock, etc., after the cargo doors are in the closed condition thereof and the ends of the lockrods are cooperatively engaged with the receiving means. Such means are shown in U.S. Pat. No. 6,233,984, referenced above. Especially for padlock-dependent security systems, however, it is all too easy for a determined thief to defeat such systems simply by cutting through the shackle of the padlock with bolt cutters or the like.

Still other proposed solutions to the problem of cargo theft have made use of the lockrods as described above. For instance, Mickelson, U.S. Pat. No. 4,372,136, describes a lock-protecting hasp comprising two slidingly mating J-shaped members and a shackle lock. The J-shaped members are each adapted to engage one of the lockrods, and to be thereafter securely mated together by means of the shackle lock. A similar device, taught in Meyer, U.S. Pat. No. 5,145,222, comprises a clamp formed of mating, telescoping tubular members each supporting L-shaped hooks. These hooks encircle the lockrods of the cargo doors, and the tubular members are telescopingly adjusted and locked in a desired, adjusted configuration by means of a key-operated, removable cylinder. Unfortunately, these and other prior art locking devices are characterized by complex construction, making their manufacture expensive and their operation unnecessarily difficult.

There consequently remains a need for a locking device for lockrod-type cargo-container closures that is at once economical to manufacture, simple to utilize, and which otherwise improves upon prior art devices.

SUMMARY OF THE DISCLOSURE

The specification describes a locking device for a cargo-container closure of the type comprising a pair of doors hingedly mounted to a body of the cargo-container, each door having associated therewith in spaced-apart relation at least one upright lockrod, the lockrods being adapted for securement to the body in a closed condition of the doors, and in which closed condition of the doors the lockrods are laterally spaced-apart a finite distance. The locking device of this disclosure generally comprises a pair of separate arms, each arm having a principal length extending between first and second ends, the first end of each arm defining a stop adapted to confront one of the lockrods, and the second ends of the arms being adapted for secure interconnection in end-to-end abutting relation. The second end and principal length of each arm are dimensioned to be receivable between a lockrod and its associated cargo door for interconnection of the second ends intermediate the lockrods. In an interconnected condition thereof the arms are characterized by a combined length exceeding the finite distance between the lockrods, the combined length being further characterized in that, when the second ends are securely interconnected intermediate the lockrods, the first end of each arm resists movement of one or the other of the lockrods to thereby prevent significant opening of the cargo doors.

The pair of arms are each substantially formed from a single piece of flat metal stock. Per one feature of this invention, the flat metal stock has a thickness of approximately ¼ inch.

According to another feature of this invention, the second end of each arm defines a terminal portion having a bore therethrough, each terminal portion being angled relative to the principal length such that, when the second ends are arranged in end-to-end abutting relation, the terminal portions abut along lapped surfaces oriented in generally parallel planes. Also per this inventive feature, the terminal portions are adapted for secure interconnection by a shackleless lock.

Per yet another feature, each stop comprises a generally V-shaped structure the angled sides of which are interconnected by an intermediate reinforcing member.

BRIEF DESCRIPTION OF THE DRAWINGS

The written description herein makes reference to the accompanying drawings, wherein like numerals refer to like or corresponding parts throughout the several views, and wherein.

DESCRIPTION OF THE ILLUSTRATED EMBODIMENT

Figure 1:
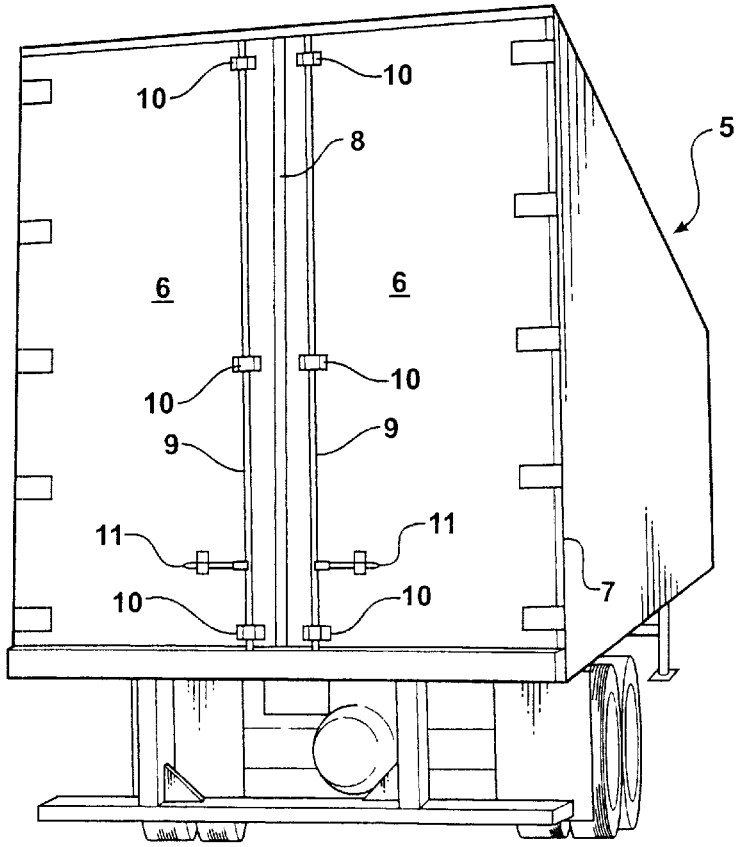
FIG - 1 PRIOR ART
FIG. 1 illustrates the closure of a conventional lockrod-type cargo-container.
Figure 2:
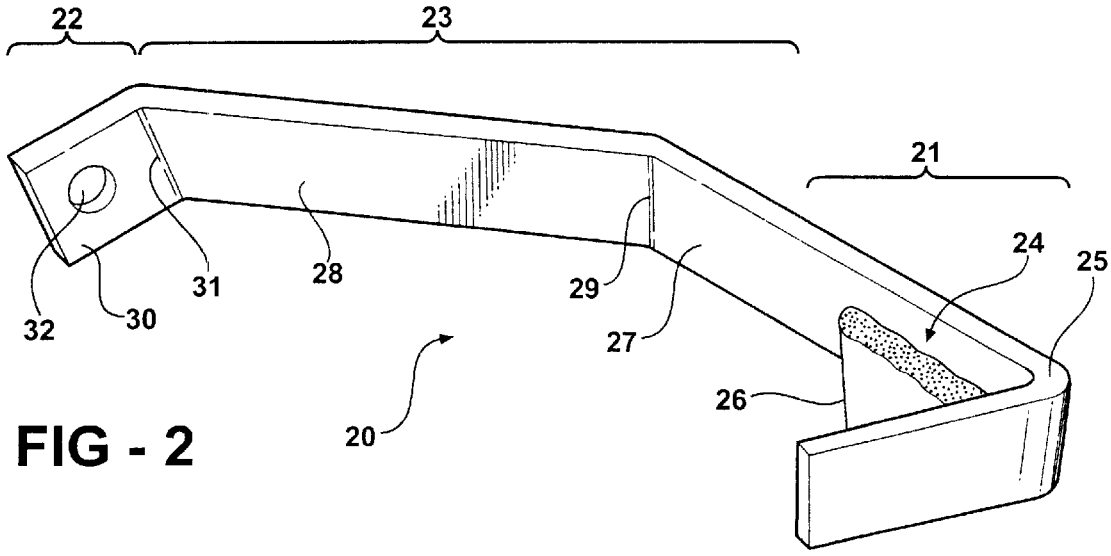
FIG. 2 depicts, in quartering perspective, one of the pair of arms comprising the locking device of the present invention.
Figure 3:
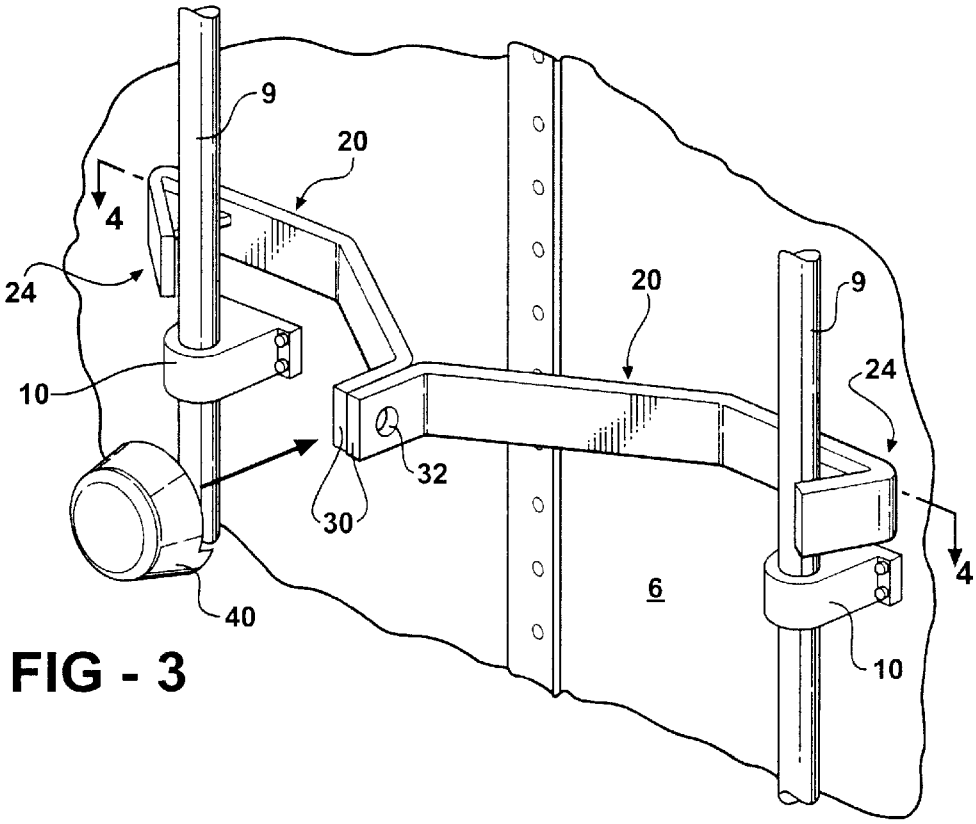
FIG. 3 is a detailed perspective view depicting the locking device of the present invention in combination with the closure of a cargo-container of the type shown in FIG. 1.
Figure 4:
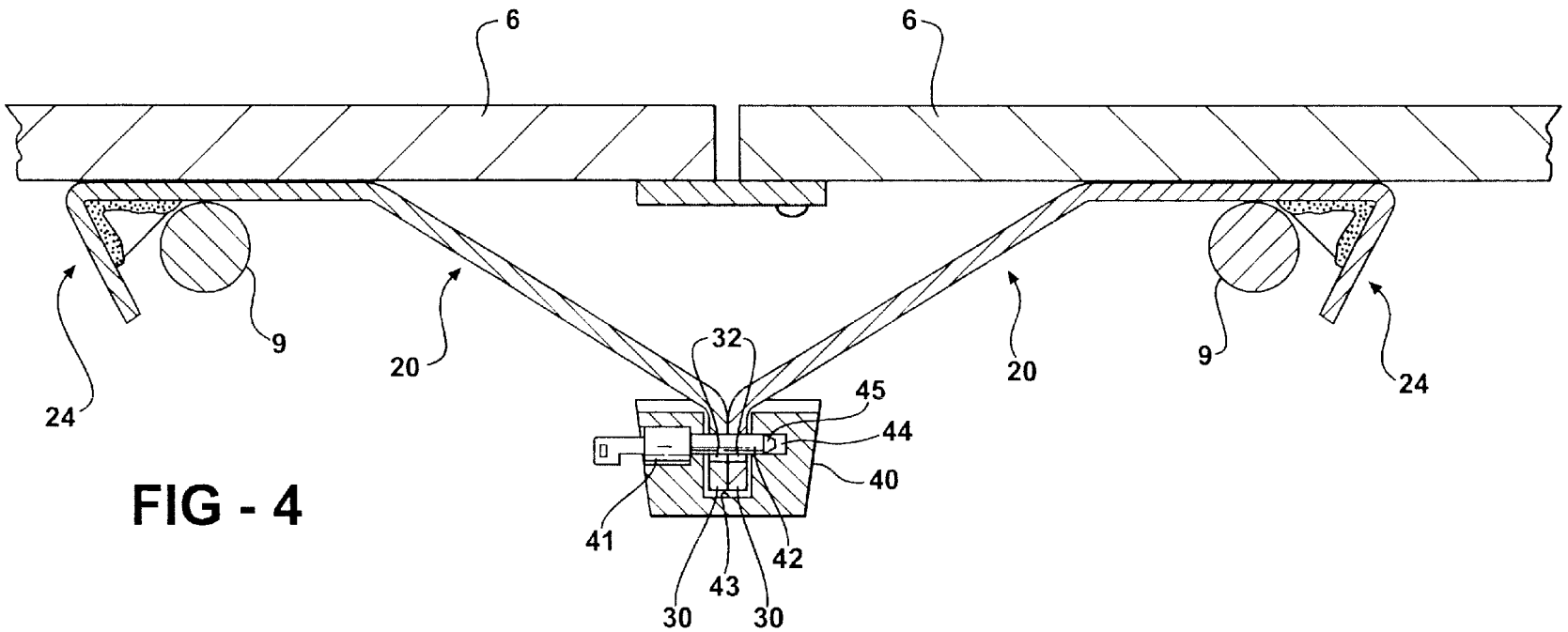
FIG. 4 is a detailed view of FIG. 3 taken along lines 4—4 of FIG. 3, and showing the ends of the arms securely interconnected by a shackleless lock.

Turning now to drawings, and more particularly to FIGS. 2–4, the present invention will be seen to comprise a locking device for use with a conventional lockrod-type closure for a cargo-container, such as, for example, that described above in reference to FIG. 1. The locking device itself generally comprises a pair of arms 20 adapted for secure interconnection in end-to-end relation intermediate the lockrods 9, whereby opposite ends of the arms 20 confront the lockrods 9 to prevent movement thereof when the cargo doors 6 are in a closed condition. More particularly, each arm 20 is characterized by a first end 21 defining a stop adapted to confront and resist radially outward movement of one or the other of the lockrods 9 in a closed condition (shown in FIGS. 3 and 4) of the cargo doors 6, a second end 22 securely interconnectable with the second end 22 of the other arm 20 in end-to-end abutting relation, and a principal length 23 extending between the first end 21 and the second end 22.

In the illustrated embodiment, the arms 20 are substantially identical in shape and dimensions, this configuration being particularly well-suited to economical construction of the locking device of this invention, as well as to the simple and relatively inexpensive replacement of one of the arms 20 in the event that either of the pair of arms 20 is lost, misplaced, etc. The arms 20 of this embodiment being substantially identical, a detailed description will be provided below for the physical structure of only one of the arms 20, it being understood that the physical structure of the other such arm 20 is substantially the same. Nevertheless, those of skill in the art will understand, with the benefit of this specification, that the shape and dimensions of each arm 20 may be altered without departing from the broader aspects of the invention as set out herein. For example, it is within the contemplation of this disclosure that the principal length of the arms 20 may be different relative each other; provided, of course, that the combined length of the interconnected pair of arms 20 is adequate to prevent significant opening of the cargo doors when the locking device is employed to lock the closure of a cargo-container as described in greater detail hereinbelow.

Each of the pair of arms 20 is preferably, though not necessarily, substantially monolithic in construction. The arms 20 are each simple yet robust in their construction, being formed of a suitably strong material, for instance metal, such that the arms 20 are each able to withstand bending or breakage such as may be accompanied by a determined effort to break into a cargo-container. In the illustrated embodiment, each of the arms 20 is substantially formed from a single piece of flat metal stock, such as steel, this metal stock material being bent or otherwise altered by known means to achieve the overall configuration of shape described further herein. Of course, other known materials and methods of manufacture may be adopted to the formation of the locking device of this invention, the exemplary construction not being intended as limiting. This, without limitation, the locking device may be cast, machined, etc.

The metal stock material is characterized by a thickness that is less than the distance between each lockrod and its associated cargo door, in order to permit insertion of a portion of each of the arms 20 between one of the lockrods and its associated cargo door in the manner described in more detail below. As indicated previously, it is common that the distance between a lockrod and its associated cargo door in conventional cargo-containers is about $^{5}/_{16}{}^{th}$'s of an inch. In the illustrated embodiment, therefor, each arm 20 is fashioned from generally planar metal stock having a thickness of about ¼ inch. This particular thickness of the metal stock material is also desirable because the resulting arms are capable of at least limited front and back movement between the cargo doors and lockrods, thereby making it difficult to cut through the arms with a saw or the like. Of course, the thickness of material from which the arms 20 are manufactured may be varied, including as necessitated by variations in the distance between a cargo door and its associated lockrod.

With continued reference to FIGS. 2 through 4, it will be seen that the stop defined at the first end 21 of each arm 20 comprises a generally V-shaped structure 24 formed by an acute bend 25 in the metal stock material. The oppositely angled sides of this V-shaped structure 24 are interconnected by an intermediate reinforcing member 26 comprising, in the illustrated embodiment, a triangularly-shaped piece of flat metal stock or other suitably strong material secured, for instance by welding, in place between these angled sides to further prevent bending of the V-shaped structure 24. This V-shaped structure 24 has, as shown in FIGS. 3 and 4, dimensions greater than the distance between a cargo door and its associated lockrod in order to resist movement of one or the other of the lockrods to thereby prevent significant opening of the cargo doors, all in the manner described in more detail below.

Of course, the stop so described may be otherwise defined, subject only to the limitation that the first end 21 of each arm 20 be configured to resist, in use of the locking device of this invention, the radially outward movement of one of the lockrods 9 in a closed condition of the doors 6, which limitation will be better understood with reference to the detailed description of the operation of this invention provided below.

With continued reference to FIGS. 2–4, the principal length 23 of each arm 20 is characterized by first 27 and second 28 sections arranged in oblique angular relationship to each other. The oblique angular relationship between the first 27 and second 28 sections may be accomplished by means of a bend 29 in the material of the arm 20 positioned at a location that is approximately half the overall length of the arm 20. In the embodiment as shown, this bend 29 defines an angle of approximately 135 degrees.

According to the embodiment of the invention as described herein, the particular angular relationship between the first 27 and second 28 sections of the principal length 23 serves to facilitate insertion of the second end 22 of each arm 20 between one of the lockrods and its associated cargo door in use of the locking device of this invention, all as described further herein. It will of course be understood that the arms 20 may be otherwise dimensioned to permit insertion of each between one of the lockrods and its associated cargo door. For instance, it is contemplated by this invention that the principal length may instead be characterized by a continuous curvature instead of the first and second sections angled relative to each other as shown and described.

The second end 22 of each arm 20 defines a terminal portion 30 angled relative to the principal length such that, when the second ends are arranged in end-to-end abutting relation, the terminal portions 30 of both arms 20 abut along lapped surfaces oriented in generally parallel planes, all as best shown in FIGS. 3 and 4. Without limitation, this angular relationship may be accomplished by means of a bend 31 in the material of the arm 20 made proximate the second end 22. In the illustrated embodiment, the terminal portions 30 are each arranged in oblique angular relationship of approximately 135 degrees relative to the adjacent second section 28 of the principal length 23. Accordingly, the first section 27 and second end 22 are oriented generally perpendicularly relative to each other, as shown. Still referring to FIGS. 2 through 4, each second end 22 comprises, in the invention as shown, a bore 32 therethrough. The bores 32 are coaxially alignable with each other when the terminal portions 30 of the second ends 22 are arranged in end-to-end abutting relation, such as shown in FIGS. 3 and 4, to permit secure interconnection of the second ends by a locking device.

Preferably, though not necessarily, the second ends are interconnectable by means of a conventional shackleless-type lock, also commonly referred to as a puck lock for its resemblance to a hockey puck. Such locks are known, being for instance described in U.S. Pat. No. 6,233,984, referenced above, and commercially available from numerous manufacturers, including, by way of example, HAPP CONTROLS (Part No. 30-1017-000). Generally, shackleless locks comprise: An approximately cylindrical body 40 constructed from a hard, durable material, such as steel, aluminum, or other metal; a retractable, key-operated tumbler 41 disposed within the body 40 when the lock is in a locked condition; and a locking bolt 42 coupled to the tumbler 41. (FIGS. 3 and 4.) A back surface of the body 40 includes a cavity 43 receivable over a structure to be locked, this cavity 43 communicating with a perpendicularly arranged passageway 44 for receiving the tumbler 41 and locking bolt 42. The locking bolt 42 is typically provided with a locking end 45 engageable with a corresponding locking structure (not shown) provided at a terminal end of the passageway 44. According to convention, the lock is placed in a locked condition by inserting the tumbler 41 and locking bolt 42 into the passageway 44, and turning a key in the tumbler 41 until the locking end 45 is engaged with the locking structure.

Turning again to FIGS. 3 and 4, the terminal portions 30 are preferably dimensioned to be receivable within the cavity 43 of a conventional shackleless lock, such as the kind described hereinabove. According to this arrangement, the terminal portions 30 are structured and arranged so that, when inserted into the cavity 43, the bores 32 are arranged coaxially both with respect to each other and the passageway 44, whereby the locking bolt 42 is receivable through the bores 32 to securely interconnect the second ends 22 when the lock is in the locked condition thereof (FIG. 4).

Figure 5:
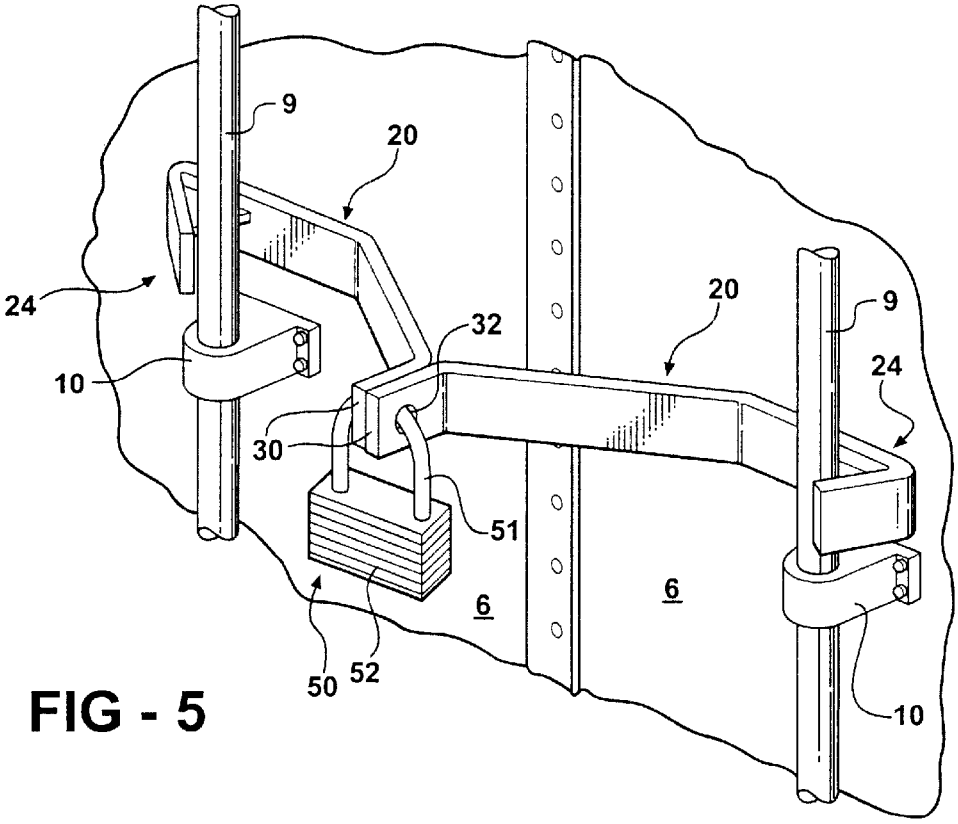
FIG. 5 depicts the locking device of the present invention according to one possible alternate arrangement, wherein the arms are securely interconnected by means of a conventional padlock.

While the manner of interconnecting the arms 20 so described is preferable as shackleless locks are not susceptible to defeat by bolt cutters and like tools, it is not intended that the means for securing together the second ends 22 of the arms 20 be limited to shackleless locks, and other known securing devices, and means for their cooperative engagement with the second ends 22 of the arms 20, may be readily adapted for use with, and are certainly comprehended by, the present invention. According to one such possible alternate arrangement shown in FIG. 5, for example, a conventional padlock 50 may be employed in place of the previously-described puck-type lock, the free end of the shackle 51 of the padlock 50 being receivable through the bores 32 and into locking engagement with the lock body 52.

With reference now being had to FIGS. 3 and 4 specifically, use and operation of the inventive locking device will be better understood.

Following closure of the cargo doors 6 and secure engagement of the ends of the lockrods 9 with their respective receiving means (not shown), all as known to those skilled in the art, each one of the arms 20 is inserted, second end 22 first, through the space defined between each of the lockrods 9 and its associated cargo door 6, until the opposing terminal portions 30 of the second ends 22 are brought into abutting, end-to-end relation with the respective bores 32 thereof in coaxial alignment intermediate the lockrods 9. Thereafter, the second ends 22 are securely interconnected by means of a shackleless lock or padlock in the manner described, or by some other suitable securing device.

While not shown in FIG. 4 for the sake of clarity, it will be understood that each arm 20 rests on an eyelet 10 such as depicted in FIG. 3, the arms being otherwise freely moveable relative to the lockrods 9.

With the second ends 22 thus securely interconnected in end-to-end abutting relation, it may be seen that the locking device of this invention forms a continuous, unitary structure having a combined length characterized in that the first ends 21 of each arm 20 are spaced-apart a distance exceeding the finite distance between the lockrods 9, and further characterized in that the oppositely arranged V-shaped stops 24 defined at the first end 21 of each arm 20 confront one or the other of the lockrods 9 to thereby resist movement of the lockrods 9 radially outwardly and away from each other coincident with hinged opening of the doors 6.

It will be noted that the lockrods 9 are not captured by either of the arms 20 in the manner contemplated by some prior art devices, but rather, when the arms 20 are securely interconnected intermediate the lockrods 9 to define a unitary structure, the V-shaped stop 24 defined at each first end 21 serves to limit the radially outward movement of one or the other of the lockrods 9 beyond the combined length defined by the interconnected arms 20. In this manner, the interconnected arms 20 serve to prevent significant (i.e., enough to permit access to the contents of the cargo vehicle) opening of the cargo doors 6, until such time as the second ends 22 of the arms 20 are disconnected by unlocking and removing the shackleless lock 50 or other securing device, whereupon the separate arms 20 may be independently withdrawn from the space between the lockrods 9 and cargo doors 6.

Of course, the foregoing is merely illustrative of the present invention; those of ordinary skill in the art will appreciate that many additions and modifications to the present invention, as set out in this disclosure, are possible without departing from the spirit and broader aspects of this invention as defined in the appended claims.

The invention in which an exclusive property or privilege is claimed is defined as follows:

1. A locking device for a cargo-container closure of the type comprising a pair of doors hingedly mounted to a body of the cargo-container, each door having associated therewith in spaced-apart relation at least one upright lockrod, the lockrods being adapted for securement to the body in a closed condition of the doors, and in which closed condition of the doors the lockrods are laterally spaced-apart a finite distance, the locking device comprising:

a pair of separate arms, each said arm having a principal length extending between first and second ends, the first end of each arm defining a stop adapted to confront one of the lockrods, and the second ends of the arms being adapted for secure interconnection in end-to-end abutting relation; and wherein the second end and principal length of each arm are dimensioned to be receivable between a lockrod and its associated cargo door for interconnection of the second ends intermediate the lockrods, and in an interconnected condition thereof the arms are characterized by a combined length exceeding the finite distance between the lockrods, the combined length being further characterized in that, when the second ends are securely interconnected intermediate the lockrods, the first end of each arm resists movement of one or the other of the lockrods to thereby prevent significant opening of the cargo doors.

2. The locking device of claim 1, wherein the second end of each arm defines a terminal portion having a bore therethrough, each terminal portion being angled relative to the principal length such that, when the second ends are arranged in end-to-end abutting relation, the terminal portions abut along lapped surfaces oriented in generally parallel planes, and wherein further the terminal portions are adapted for secure interconnection by a shackleless lock.

3. The locking device of claim 1, wherein each stop comprises a generally V-shaped structure the angled sides of which are interconnected by an intermediate reinforcing member.

4. The locking device of claim 1, wherein the pair of arms are each substantially formed from a single piece of flat metal stock.

5. The locking device of claim 4, wherein the flat metal stock has a thickness of approximately ¼ inch.

6. A locking device for a cargo-container closure of the type comprising a pair of doors hingedly mounted to the body of the cargo-container, each door having associated therewith in spaced-apart relation at least one upright lockrod, the lockrods being adapted for securement to the body in a closed condition of the doors, and in which closed condition the lockrods are laterally spaced-apart a finite distance, the locking device comprising:

a pair of rigid arms, each said arm having a principal length extending between first and second ends, the first end defining a stop adapted to confront one of the lockrods, and the second end and principal length dimensioned to be receivable between one of the lockrods and its associated cargo door; and wherein the second ends adapted for secure interconnection in end-to-end abutting relation by a shackleless lock; and wherein, when the second ends are in the securely interconnected condition thereof, the first ends of each arm are spaced-apart a distance exceeding the finite distance between the lockrods, whereby the first ends are capable to resist movement of the lockrods to thereby prevent significant opening of the cargo doors.

7. The locking device of claim 6, wherein the second end of each arm defines a terminal portion having a bore therethrough, each terminal portion being angled relative to the principal length such that, when the second ends are arranged in end-to-end abutting relation, the terminal portions abut along lapped surfaces oriented in generally parallel planes, and wherein further the terminal portions are dimensioned to receive a shackleless lock.

8. The locking device of claim 6, wherein the principal length of each of the pair of arms is further characterized by first and second sections arranged in obtuse angular relationship to each other, and wherein further the angular relationship between the first section and the second end of each of the pair of arms is approximately 90 degrees.

9. The locking device of claim 6, wherein each stop comprises a generally V-shaped structure the angled sides of which are interconnected by an intermediate reinforcing member.

10. The locking device of claim 6, wherein the pair of arms are each substantially formed from a single piece of flat metal stock.

11. The locking device of claim 10, wherein the flat metal stock has a thickness of approximately ¼ inch.

12. A locking device for a cargo-container closure of the type comprising a pair of doors hingedly mounted to the body of the cargo-container, each door having associated therewith in spaced-apart relation at least one upright lockrod, the lockrods being adapted for securement to the body in a closed condition of the doors, and in which closed condition the lockrods are laterally spaced-apart a finite distance, the locking device comprising:

a pair of rigid metal arms, each said arm having a first end defining a generally V-shaped stop having dimensions greater than the distance between a cargo door and its associated lockrod, a principal length extending from the first end and having first and second sections arranged in obtuse angular relation to each other, and a second end extending from and arranged in obtuse angular relation to the second section of the principal length, the second end defining a terminal portion;

wherein the angular relationship between the first section and the second end of each of the pair of arms is approximately 90 degrees;

wherein the second end and principal length of each arm are dimensioned to be receivable between one of the lockrods and its associated cargo door; and wherein the second ends are adapted for end-to-end abutment with each other along lapped surfaces oriented in generally parallel planes, and the terminal portions are adapted for secure interconnection by a shackleless lock.

13. The locking device of claim 12, wherein the pair of arms are each substantially formed from a single piece of flat metal stock.

14. The locking device of claim 13, wherein the flat metal stock has a thickness of approximately ¼ inch.

* * * * *

UNITED STATES PATENT AND TRADEMARK OFFICE

CERTIFICATE OF CORRECTION

PATENT NO. : 6,591,641 B1
DATED : July 15, 2003
INVENTOR(S) : Cann

It is certified that error appears in the above-identified patent and that said Letters Patent is hereby corrected as shown below:

Title page,
Item [57], ABSTRACT,
Line 5, after "lockrod," please insert -- , --;

Column 1,
Line 50, please delete "scam," and insert -- seam --.

Signed and Sealed this

Fourth Day of November, 2003

JAMES E. ROGAN
*Director of the United States Patent and Trademark Office*